United States Patent [19]

Müller

[11] Patent Number: 4,984,508

[45] Date of Patent: Jan. 15, 1991

[54] PISTON DRIVE

[76] Inventor: Fritz Müller, Neuer Wasen 6, 7118 Ingelfingen-Criesbach, Fed. Rep. of Germany

[21] Appl. No.: 328,480

[22] Filed: Mar. 24, 1989

[30] Foreign Application Priority Data

Mar. 31, 1988 [DE] Fed. Rep. of Germany ..... 3811110

[51] Int. Cl.[5] ..... F15B 15/24

[52] U.S. Cl. ..... 92/13.5; 92/57

[58] Field of Search ..... 92/128, 5 R, 13, 13.5, 92/13.6, 13.51, 252; 91/1, 462–467

[56] References Cited

U.S. PATENT DOCUMENTS

| | | | |
|---|---|---|---|
| 579,186 | 3/1897 | Sickafoose et al. | 91/467 |
| 708,598 | 9/1902 | Thomas | 91/466 |
| 856,569 | 6/1907 | Catlin | 91/465 |
| 2,922,397 | 1/1960 | Haanes | 92/13.5 |
| 3,003,470 | 10/1961 | Geyer | 92/13.5 |
| 3,896,280 | 7/1975 | Blake | 200/82 E |
| 4,176,586 | 12/1979 | Stoll et al. | 92/5 R |

FOREIGN PATENT DOCUMENTS

| | | | |
|---|---|---|---|
| 46840 | 11/1972 | Japan | 324/207.11 |
| 309163 | 9/1971 | U.S.S.R. | 251/285 |

*Primary Examiner*—Edward K. Look
*Assistant Examiner*—F. Daniel Lopez
*Attorney, Agent, or Firm*—Henry M. Feiereisen

[57] ABSTRACT

A piston drive such as a piston drive for actuating a valve includes a piston which reciprocates between two end positions which are defined by respective sleeve-shaped inserts projecting into the path of movement of the piston and being axially displaceable by respective worm drives. One insert with the pertaining worm drive is usable for emergency actuation while the other insert with the pertaining worm drive is usable for limiting the stroke of the piston.

18 Claims, 1 Drawing Sheet

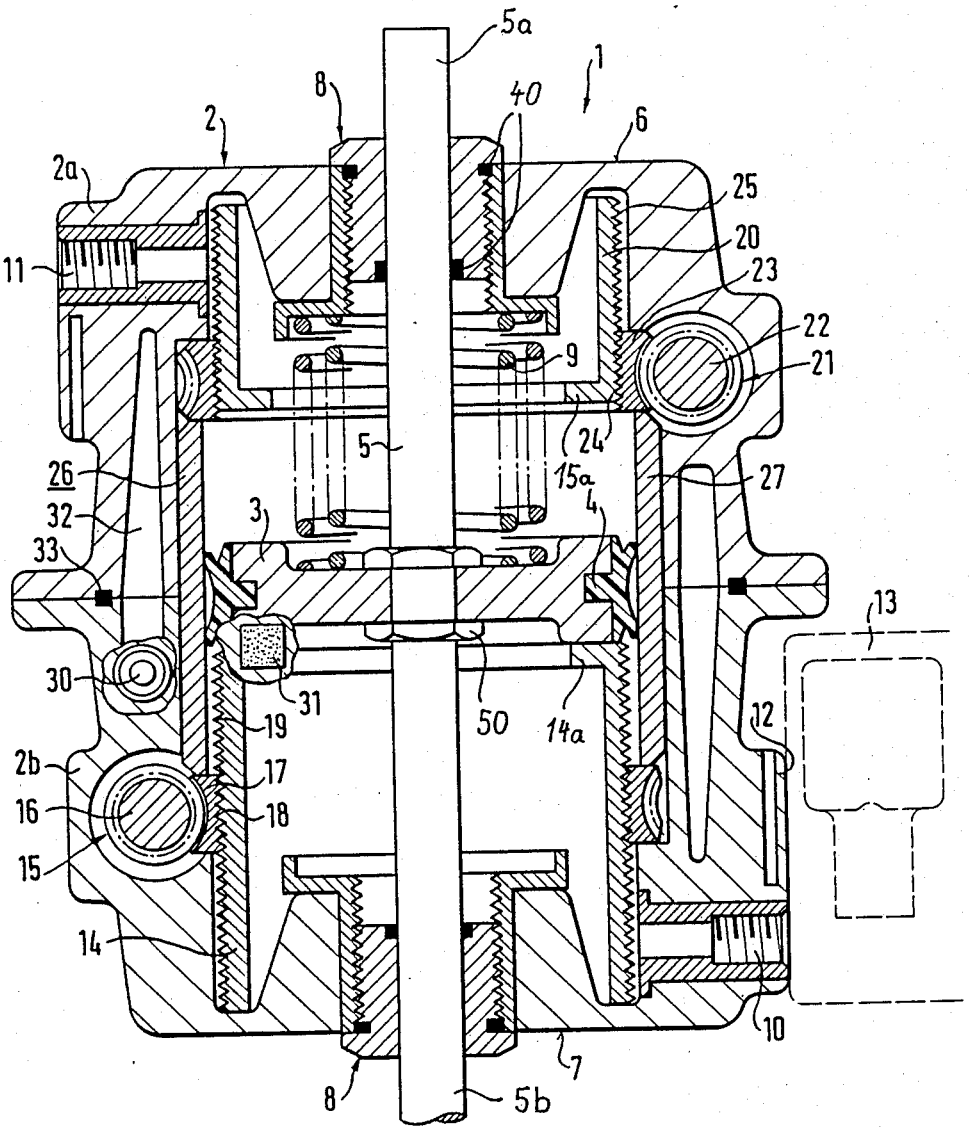
5a
1
8
40
6
2
2a
25
20
11
23
22
9
21
24
5
15a
27
26
4
32
3
33
13
30
31
50
14a
12
19
2b
17
16
18
15
14
10
7
8
5b

PISTON DRIVE

BACKGROUND OF THE INVENTION

The present invention refers to a piston drive, in particular to a piston drive for actuating a valve or the like.

In general, piston drives are known which include a housing accommodating a suitably sealed reciprocating piston which includes a piston rod acting upon an operating device in dependence on the stroke of the piston. Conventional piston drives include various units such as an emergency actuation, stroke limitation as well as an end position control for the piston which units represent separate components cooperating with the piston rod of the piston drive and mounted to the housing usually at the axial ends thereof. Such an arrangement, however, renders it difficult to find space for connections to the operating device. Since the piston drive with the separate units for performing certain functions requires a relative large space for the installation, problems were frequently encountered because not enough installation space was available.

SUMMARY OF THE INVENTION

It is thus an object of the present invention to provide an improved piston drive obviating the afore-stated drawbacks.

This object and others which will become apparent hereinafter are attained in accordance with the present invention by providing at least one insert adjustably arranged within the housing and projecting into the path of movement of the piston for defining one end position of the piston. Preferably, the insert is actuated by a worm drive which is arranged within the housing and accessible from the outside.

Through the provision of such an insert, the respective end position of the piston can easily be adjusted by actuating the worm drive in case safety reasons dictate such a repositioning. At the same time, the axial displacement of the insert in cooperation with the worm drive allows a modification of the stroke of the piston.

Suitably, the insert is sleeve-shaped and includes an inwardly directed collar to provide a sufficient support surface for the piston in the one end position.

According to a further feature of the invention, the piston drive includes a second axially displaceable insert projecting into the path of movement of the piston for defining the other end position of the piston. The insert is also sleeve-shaped and acted upon by a second worm drive arranged in said housing and axially displacing the second insert.

By placing two axially adjustable inserts at opposite side of the piston and within the path of movement of the piston, it is possible to use one insert with the pertaining worm drive for emergency actuation while the other insert with the pertaining worm drive is usable for limiting the stroke of the piston.

According to yet another feature of the present invention, the housing incorporates a limit switch for determining one end position of the piston. The limit switch may be a proximity switch or a reed switch which cooperates with a magnet.

Through the provision of such a piston drive, the units for performing certain functions such as emergency actuation, stroke limitation and end position control, are integrated within the housing to give the piston drive a compact design so that the use of separate components mounted to the outside of the housing is avoided.

According to yet another feature of the present invention, the piston drive with its integrated units is symmetrically designed relative to a plane perpendicular to the piston rod so that the piston drive is universally usable and easily installable. Suitably, the piston drive is made of two essentially identical housing parts in which the inserts and the worm drives are arranged as mirror images of each other. Such a symmetric arrangement considerably simplifies the making of the piston drive since essentially identical parts can be used for its production and assembly.

BRIEF DESCRIPTION OF THE DRAWING

The above and other objects, features and advantages of the present invention will now be described in more detail with reference to the accompanying drawing in which:

The sole FIGURE shows a longitudinal section of one embodiment of a piston drive in accordance with the present invention.

DETAILED DESCRIPTION OF A PREFERRED EMBODIMENT

Referring now to the sole FIGURE of the drawing, there is shown a longitudinal sectional view of a piston drive generally designated by reference numeral 1. The piston drive 1 includes a housing 2 which is parted along its center and made of two essentially identical housing parts *2a, 2b*. The housing 2 accommodates a piston 3 which reciprocates in axial direction thereof and is provided about its outer circumference with a double lip seal 4.

Connected to the piston 3 at a central location thereof is a piston rod 5 which extends beyond the axial ends 6, 7 of the housing 2 for allowing attachment of suitable devices such as valve bodies. The piston rod 5 is made of two parts *5a, 5b* which are suitably attached at their opposing ends to the piston 3 e.g. by means of a nut 50. At the axial ends 6,7 of the housing 2, the piston rod 5 is suitably guided by a guide assembly generally designated by reference numeral 8 and suitably sealed by means of gaskets 40.

In the nonlimiting example as shown in the FIGURE, the piston 3 is biased toward one end position, i.e. the lower end position in the FIGURE, by a spring 9 which extends within the housing part *2a* between the piston 3 and the respective guide assembly 8. In addition to or instead of the spring load, the movement of the piston 3 within the housing 2 may be attained by a pressure fluid control which includes one port 10 in vicinity of the axial end 7 of the housing part *2b* and diametrically opposite thereto another port 11 in vicinity of the axial end 6 of the housing part *2a*. Pressure fluid is supplied and discharged through the ports 10 and 11 to act upon the exposed piston surfaces so that the piston 3 reciprocates in dependence on the prevailing pressure conditions at the top side and bottom side thereof.

Each housing part *2a, 2b* is provided with an integral mounting flange 12 which allows attachment of a directional control valve (not shown) and/or a pilot valve for a pilot control as indicated in broken lines 13 at the right hand side of the FIGURE so that the housing 2 is usable as support for the units of the pressure fluid control.

The lower end position of the piston 3 is defined by a sleeve-shaped or cylindrical insert 14 which is placed within the housing part 2a and projects into the path of movement of the piston 3. At its end facing the piston 3, the insert 14 is provided with an inwardly directed annular collar 14a for supporting the piston 3 at its underside when being in the lower end position.

At its outside, the insert 14 is provided with an external thread 19 which meshes with the facing thread 18 of a worm wheel 17 stationarily fixed to the housing 2. The worm wheel 17 is part of a worm drive which is generally designated by reference numeral 15 and further includes a drive spindle 16 which traverses the housing 2 approximately perpendicular to the piston rod 5 i.e. the drive spindle 16 extends in direction of the broadside of the housing 2. At the distant end to the worm wheel 17, the drive spindle 16 is free to allow attachment of a tool for rotating and actuating the spindle 16 from outside the housing 2.

In the nonlimiting example of the FIGURE, the worm drive 15 serves as manual emergency actuation for the piston drive 1. In the event the piston 3 rests on the support 14a of the insert 14 and the control of the piston drive 1 by means of the pressure fluid and/or the spring load fails or is disturbed, then the piston 3 can be axially displaced by rotating the spindle 16 which rotation is translated via the worm wheel 17 and threads 18, 19 into an axial displacement of the insert 14 to thereby shift the piston 3 in axial direction.

At the other side of the piston 3 and in axial extension of the first insert 14 is a second sleeve-shaped or cylindrical insert 20 which is also disposed in the path of movement of the piston 3 to define the upper or other end position of the piston 3. The insert 15 is arranged within the housing part 2a and includes an inwardly directed collar 15a at its end facing the piston 3 so that the stroke of the latter is limited by abutting the collar 15a. For adjusting its position within the housing part 2a and thus for adjusting the stroke of the piston 3, the insert 15 is controllable by a worm drive generally designated by reference numeral 21 and located approximately diametrically opposite to the worm drive 15.

The worm drive 21 is mounted to the housing part 2a at its exterior so as to be accessible from outside and includes a drive spindle 22 which traverses the housing part 2 and extends approximately parallel to the drive spindle 16 of the worm drive 15. The drive spindle 22 is in mesh with a worm wheel 23 which carries an internal thread 24 in engagement with an external thread 25 arranged along the outside of the second insert 20.

In the nonlimiting example of the FIGURE, the second insert 20 is adjustable by the worm drive 21 so as to limit the stroke of the piston 3. By suitably turning the drive spindle 22, the insert 20 is shifted via the meshing worm wheel 23 and threads 24, 25 in an axial direction so as to define with its collar 15a a stop for the upper end position of the piston 3.

Arranged in the interior of the housing 2 and extending between the facing surfaces of the worm wheels 17 and 23 of both worm drives 15 and 21 is a spacer element which is generally designated by reference numeral 26 and may be designed as a spacer sleeve 27. By means of the spacer sleeve 27, the worm wheels 17, 23 are fixed in position and kept at a predetermined axial distance from each other. As shown in the FIGURE, the double lip seal 4 located at the outer circumference of the piston 3 bears against the inside wall surface of the spacer sleeve 27.

It will be appreciated that the purpose of the first and second worm drives 15, 21 and their associated first and second inserts 14, 20 may also be reversed i.e. the emergency actuation is attained by the second worm drive 21 and the insert 20 while the first worm drive 15 is used for limiting the stroke of the piston 3 via the insert 14.

For controlling and monitoring the end position of the piston 3, the piston drive 1 is further provided with a limit switch 30 which operates in non-contacting manner and may be a proximity detector or a reed switch. The limit switch 30 is located for example in the housing part 2b in vicinity of the collar 14a and is axially shiftable along a slot 32 extending in the housing parts 2a, 2b over the entire stroke range of the piston 3. Thus, when adjusting the end positions of the piston 3, the limit switch 30 can be accordingly readjusted.

In the event the limit switch 30 is a reed switch, the piston 3 is provided at its underside with a magnet 31 such as a permanent magnet which cooperates with the reed switch.

As already set forth, the housing 2 includes essentially two identical housing parts 2a, 2b which are sealingly connected to each other via a seal 33. The housing parts 2a, 2b include in corresponding manner the guide assemblies 8, the sleeve-shaped inserts 14, 20 and the worm drives 15, 21. Thus, when defining a plane perpendicular through the piston rod 5, it will be recognized that all the units integrated in the piston drive 1 are mirror images of each other and thus are symmetrically arranged.

By integrating the units for emergency actuation, stroke limitation and end position control within the housing, the axial ends 6, 7 of the housing are unobstructed so that suitable devices may be easily attached to the piston rod 3 which projects beyond the axial ends 6, 7 of the housing 2.

While the invention has been illustrated and described as embodied in a piston drive, it is not intended to be limited to the details shown since various modifications and structural changes may be made without departing in any way from the spirit of the present invention.

What is claimed as new and desired to be protected by Letters Patent is set forth in the appended claims:

1. A piston drive, comprising:
   a housing;
   piston means including a piston reciprocating in said housing between two end positions;
   insert means including a first insert arranged in said housing and projecting into the path of movement of said piston for defining one of said end positions of said piston; and
   driving means for axially displacing said first insert to allow adjustment of said one end position of said piston, said driving means including a first worm drive arranged in said housing and acting upon said insert.

2. A piston drive as defined in claim 1 wherein said piston means further includes a piston rod attached to said piston and acting upon an operating device in dependence on the movement of said piston.

3. A piston drive as defined in claim 2 wherein said housing defines a central plane of symmetry, said insert means and said driving means being arranged in said housing symmetrically relative to said plane.

4. A piston drive as defined in claim 1 wherein said insert is sleeve-shaped.

5. A piston drive as defined in claim 3 wherein said insert is provided at its end facing said piston with an inwardly directed collar against which said piston abuts in said one end position.

6. A piston drive as defined in claim 1 wherein said insert means includes a second insert projecting into the path of movement of said piston for defining the other one of said end positions of said piston, said driving means including a second worm drive arranged in said housing and acting upon said second insert for displacing said second insert in axial direction.

7. A piston drive as defined in claim 6 wherein said second insert is sleeve-shaped.

8. A piston drive as defined in claim 7 wherein said sleeve-shaped second insert is provided at its end facing said piston with an inwardly directed collar against which said piston abuts to define said other end position.

9. A piston drive as defined in claim 6 wherein said first insert and said first worm drive is arranged at one axial side of said piston and said second insert and said second worm drive is arranged at the other axial side of said piston.

10. A piston drive as defined in claim 6 wherein said first worm drive includes a drive spindle accessible from outside said housing and a worm wheel meshing with said drive spindle and provided with a thread engaging a thread of said first insert so that a suitable actuation of said drive spindle is converted into an axial displacement of said first insert.

11. A piston drive as defined in claim 10 wherein said second worm drive includes a drive spindle accessible from outside said housing and a worm wheel meshing with said drive spindle and provided with a thread engaging a thread of said second insert so that a suitable actuation of said drive spindle is converted into an axial actuation of said second insert.

12. A piston drive as defined in claim 11, and further comprising a spacer element arranged in said interior of said housing for maintaining said worm wheels of said first and second worm drives at an axial distance to each other, said spacer element bearing with its axial ends upon said worm wheels at their end faces opposing each other.

13. A piston drive as defined in claim 12 wherein said spacer element is a spacer sleeve.

14. A piston drive as defined in claim 6 wherein said second worm drive defines with said second insert a stroke limitation unit for said piston.

15. A piston drive as defined in claim 1 wherein said first worm drive defines with said first insert an emergency actuating unit for the piston drive.

16. A piston drive as defined in claim 1, and further comprising control means for determining the position of said piston, said control means including a limit switch adjustably arranged in said housing and operating in non-contacting manner, and a magnet disposed in said housing and cooperating with said limit switch.

17. A piston drive as defined in claim 16 wherein said housing includes an axial slot in which said limit switch is adjustably fixed.

18. A piston drive as defined in claim 1 wherein said housing is parted at the center thereof and is composed of two essentially identical housing parts.

* * * * *